US005575479A

United States Patent [19]

Ayres

[11] Patent Number: 5,575,479

[45] Date of Patent: Nov. 19, 1996

[54] PROJECTILE IMPACT INDICATING TARGET

[75] Inventor: John A. Ayres, Lapeer, Mich.

[73] Assignee: Nu-Tech & Engineering, Inc., Lapeer, Mich.

[21] Appl. No.: 532,058

[22] Filed: Sep. 22, 1995

[51] Int. Cl.[6] ..... F41J 9/16

[52] U.S. Cl. ..... 273/378; 273/363; 273/381; 273/380

[58] Field of Search ..... 273/363, 362, 273/364, 378, 374, 384, 383, 380, 381

[56] References Cited

U.S. PATENT DOCUMENTS

| | | | |
|---|---|---|---|
| 727,419 | 5/1903 | Nelson | 273/363 |
| 975,711 | 11/1910 | Newbold . | |
| 3,169,767 | 2/1965 | Bingham, Jr. . | |
| 3,411,778 | 11/1968 | Barry | 273/363 |
| 4,124,550 | 11/1978 | Kobayashi et al. . | |
| 4,243,228 | 1/1981 | Marcella . | |
| 4,247,116 | 1/1981 | McQuary . | |
| 4,352,496 | 10/1982 | Della Rovere | 273/363 |
| 4,802,676 | 2/1989 | Descor et al. | 273/363 |
| 5,181,724 | 1/1993 | Spadoni . | |
| 5,316,313 | 5/1994 | Moore . | |
| 5,389,142 | 2/1995 | Moore . | |
| 5,397,132 | 3/1995 | Maryska . | |

*Primary Examiner*—Mark S. Graham
*Attorney, Agent, or Firm*—C. J. Fildes & Co.

[57] ABSTRACT

A projectile impact indicating target for sport shooting includes a frame, a projectile impact sensor mounted on the frame for sensing projectile impact, and an impact indicator releasably restrained by the projectile impact sensor for indicating projectile impact with the target.

15 Claims, 3 Drawing Sheets

FIG-1
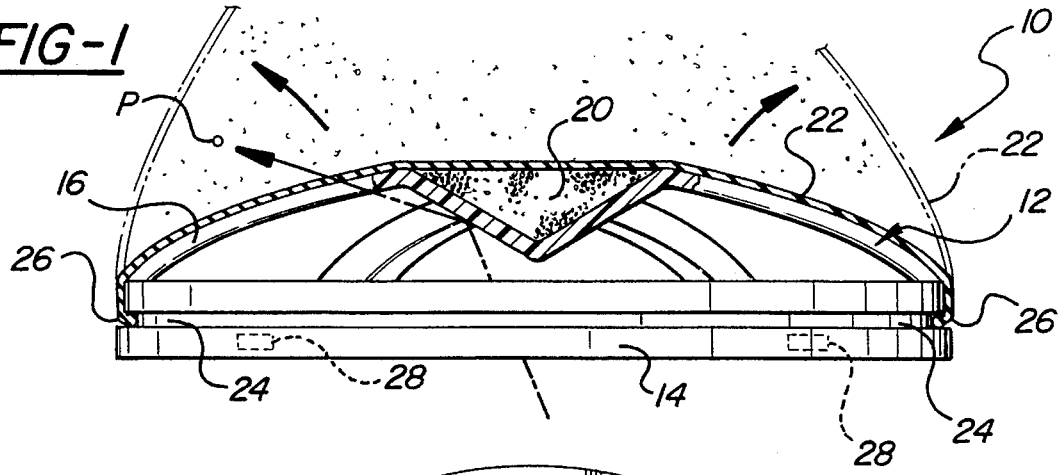
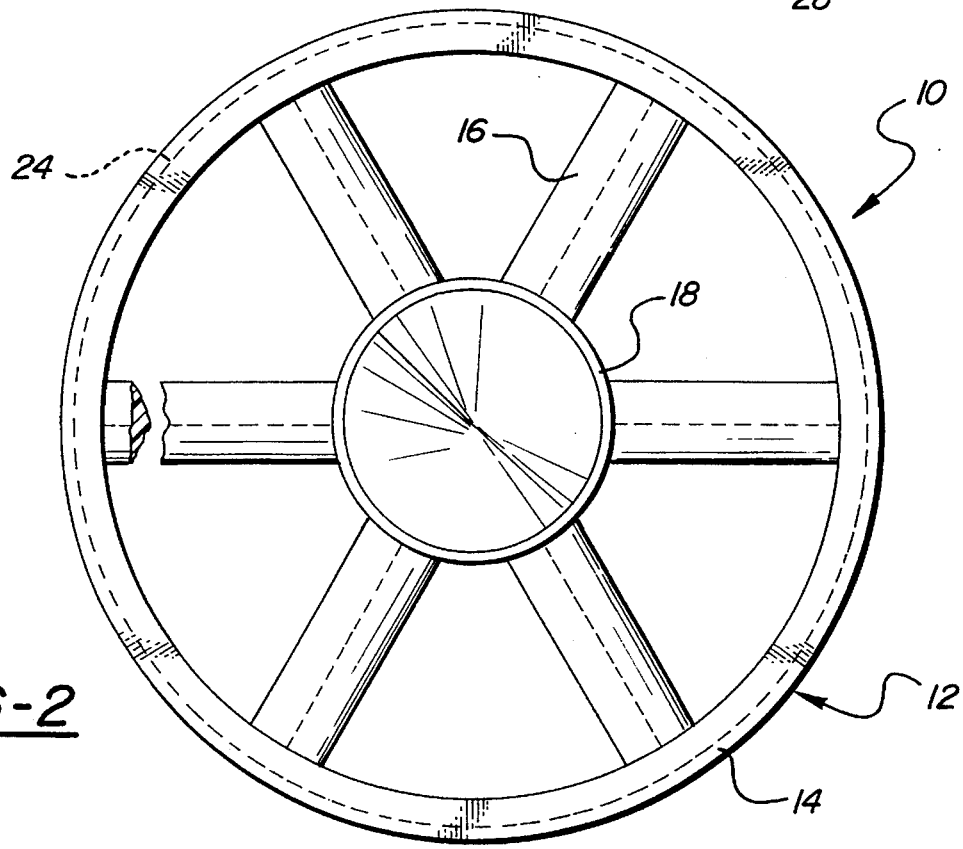
FIG-2
FIG-3
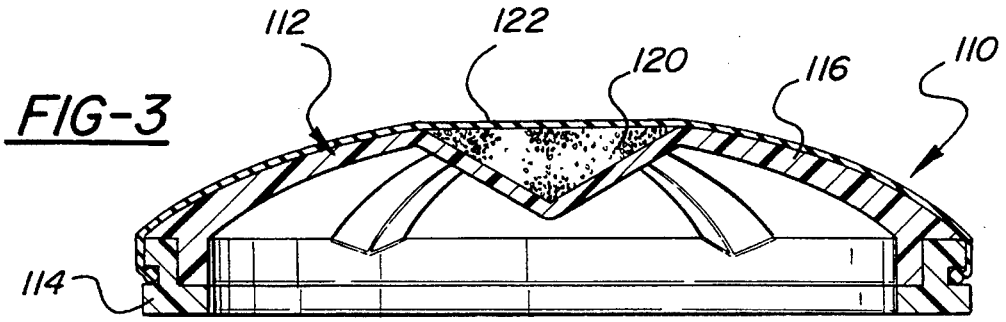

FIG-4
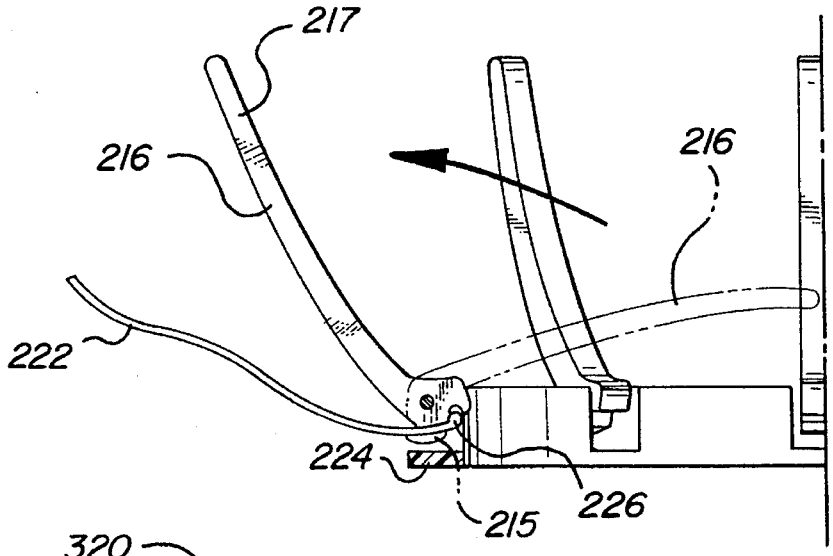
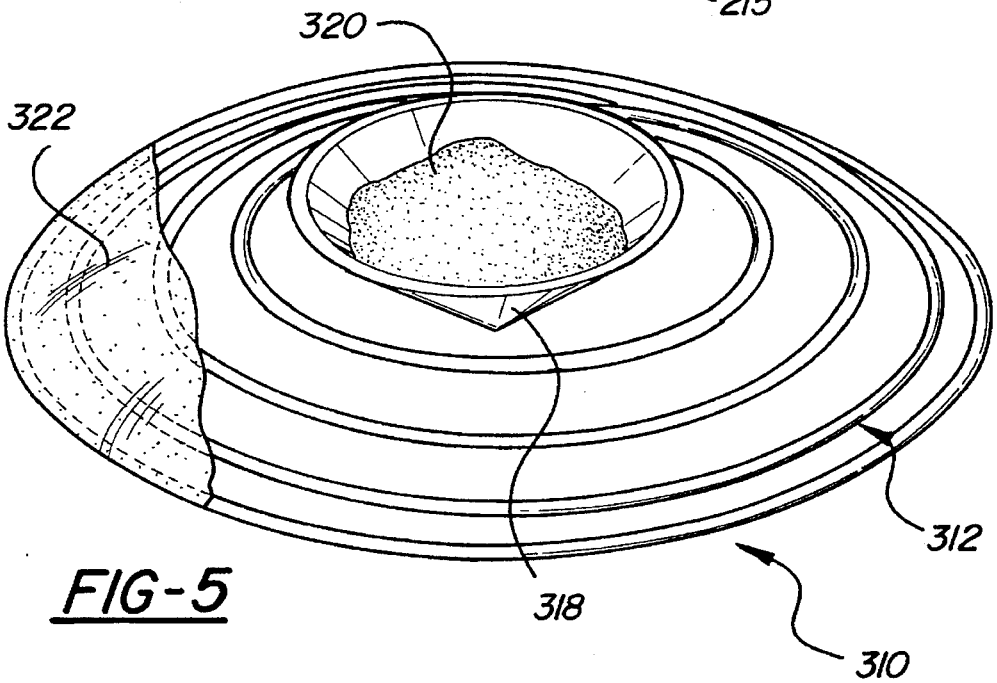
FIG-5
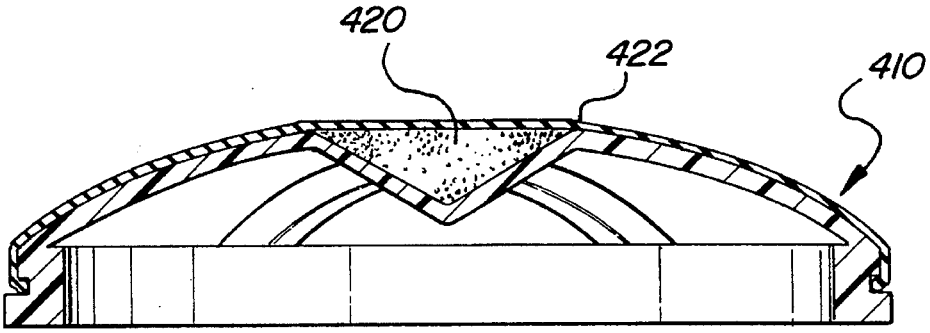
FIG-6

PROJECTILE IMPACT INDICATING TARGET

FIELD OF THE INVENTION

This invention relates generally to sport shooting targets and more particularly to a projectile impact indicating target that can be constructed in reusable or biodegradable embodiments.

BACKGROUND OF THE INVENTION

Conventional sport shooting target designs include the standard clay pigeon designs as well as other flying targets and a rabbit design which hops as it rolls across the ground.

Typical sporting clay targets are made by molding a black composite of tar pitch and powdered limestone (calcium carbonate) and painting them bright colors for visibility. These targets are strong enough to be thrown by a machine, but frangible enough to break when hit with one or two pellets from a shot gun.

It is generally recognized that these conventional targets are toxic when eaten by animals and that they do not biodegrade or decompose, consequentially they quickly leave large amounts of unsightly residue in hard to clean areas of sporting clay courses.

Several attempts have been made to develop biodegradable clay pigeons to solve the toxicity and residue problems. Two known solutions include ice targets and targets using starch type binders. However, ice targets must be manufactured close to the point of use to be practical for sporting clay courses and have not found practical application because of the slow complex processes required to produce them. Starch based targets soften under high humidity conditions and become unusable.

SUMMARY OF THE INVENTION

The present invention provides an improved projectile impact indicating target for use in sport shooting wherein the impact of a projectile or shot from a gun, slingshot or bow with the target is observed.

More particularly, the invention provides a target having a shot impact sensor that can sense one or more projectile or gun shot impacts and an indicator, activated by the shot impact sensor, for visual or audible indication of the shot impacts.

One embodiment of the invention contemplates a shot resistant reusable target frame for carrying the shot impact sensor and the shot impact indicator. Alternatively the target frame can be made of biodegradable materials. In one arrangement of the invention, the frame facilitates magnetic pickup by including a magnetically affected material.

One embodiment of the present invention comprises a high impact plastic frame having a steel insert to facilitate magnetic pickup and added weight. In one embodiment, the frame is generally dome-shaped and provides a container for containing the shot impact indicator. The frame also provides support for a stretched elastomeric shot impact sensor normally stretched over the frame which becomes ruptured upon impact with a projectile.

Preferably, the frame is designed to deflect shot through the elastomeric shot impact sensor and has considerable open area for shot to pass through the stretched elastomeric material. The stretched elastomeric shot impact sensor also serves to retain the visible or audible shot impact indicator contained in the container. When shot hits the target, the stretched elastomeric shot impact sensor ruptures and allows the shot impact indicator to release a visible indication or alternatively it allows air flow to activate an audible indication of a hit.

In another embodiment of the invention the frame is of two piece construction and in another the frame includes arcuate spokes hinged to a base portion. In this embodiment the arcuate spokes normally held in place by the shot impact sensor are released to hinge outwardly as the sensor is ruptured.

In the biodegradable embodiment, the frame is of a one piece molded construction and the shot impact sensor is used only to contain the shot indicator until the sensor is ruptured.

These and other features and advantages of the invention will be more fully understood from the following detailed description of the invention taken together with the accompanying drawings.

BRIEF DESCRIPTION OF THE DRAWINGS

In the drawings:

FIG. 1 is a sectional elevational view of a reusable projectile impact indicating target constructed in accordance with the invention illustrating a reusable frame, a projectile impact sensor and a container containing a releasable impact indicator;

FIG. 2 is a plan view of the reusable frame of FIG. 1 illustrating an integral frame base and arcuate spoke structure;

FIG. 3 is a sectional elevational view of an alternative reusable impact indicating target of two piece frame construction;

FIG. 4 is a sectional elevational view of yet another alternative frame construction for the reusable projectile impact indicating target wherein the spokes are hingedly attached to the base portion;

FIG. 5 is a view of a reusable projectile impact indicating target constructed in accordance with an alternative embodiment of the invention illustrating a frame of a spiral wound wire construction;

FIG. 6 is a sectional elevational view of a biodegradable projectile impact indicating target constructed in accordance with a biodegradable embodiment of the invention illustrating a one piece molded design;

DETAILED DESCRIPTION OF THE INVENTION

Figure 7:
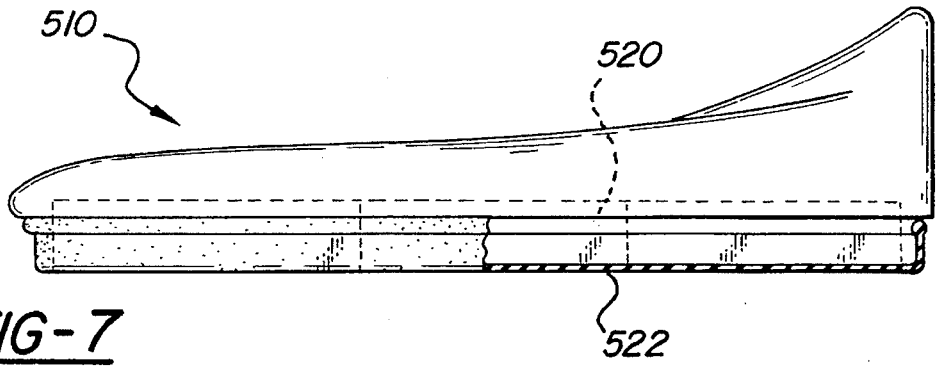
FIG. 7 is an elevational view of a target embodying the invention constructed to look like an airplane.

Referring now to the drawings in detail, numerals 10,110, 210,310,410,510,610 generally indicate a projectile impact indicating target embodying the present invention for use in sport shooting. The target 10 can be of reusable, biodegradable or combined reusable/biodegradable construction as herein more fully described.

As illustrated in the embodiment of FIGS. 1 and 2, the target 10 generally comprises a reusable frame 12 in the form of a hollow dome-shaped structure. As will become apparent from the following description, the target can be made into any number of shapes for use as moving or still targets. The frame 12 includes a circular shaped base portion 14 having arcuate spokes 16 extending from the base portion to define the dome-shape. At the apex of the dome-shaped structure is a container 18 for a containing an impact indicator 20 for indicating a projectile impact or shot impact with the target 10. A projectile impact sensor 22 defined by an elastomeric material is mounted over the dome-shaped structure.

In the embodiment illustrated, the frame 12 includes a groove 24 extending around the periphery of the base portion 14 and the projectile impact sensor 22 includes a bead 26 that is fittable in the groove to facilitate the mounting of the sensor on the frame. Alternatively, the groove 24 and bead 26 can be eliminated and the impact sensor 22 stretched over the frame 12 and pulled around the bottom of base portion 14. Preferably, the projectile impact sensor 22 is stretched near its elastic limit over the frame 12 so that upon being struck by a projectile or shot P, the sensor is ruptured.

The stretched projectile impact sensor 22 provides a lifting surface for lifting the target 10 when the target is thrown through the air. The stretched projectile impact sensor 22 also acts as a cover for the container 18. Upon being hit by a projectile, the projectile impact sensor 22 is ruptured and destroyed as shown in phantom line construction thereby eliminating the lifting surface provided causing the target 10 to fall and also uncovering the container 18 to release an impact indicator 20.

With continued reference to FIGS. 1 and 2 the base portion 14 of the frame 12 has been provided with an optional metal insert 28 that allows for magnetic pickup of the target 10 after it has been downed by a shot. In addition, the arcuate spokes 16 have a generally triangular cross-sectional shape for deflecting any shot, consisting of pellets or BBs, through the projectile impact sensor 22. The container 18 is constructed of a conical shape also to facilitate the deflection of shot through the projectile impact sensor 22.

In the embodiment illustrated, the frame 12 is made from a reusable plastic material such as urethane or polycarbonate material that can be hit with shot without damage.

The impact indicator 20 contained in container 18 can be a colored powdered material or a coil of streamers that are released when the projectile impact sensor 22 is ruptured. Alternatively the impact indicator 20 can be an audible indicator such as a whistle, as is known, activated by sudden air flow caused by the rupture of the sensor 22.

FIG. 3 illustrates a projectile impact indicating target 110 having a two piece frame 112 design. The frame 112 is comprised of a base portion 114 and a separable arcuate spoke portion 116. Both portions 114,116 are held together by the projectile impact sensor 122 while the sensor is intact. Upon being struck by a projectile or shot, the two portions 114,116 separate and the impact indicator 120 is released or activated. Alternatively, both portions 114,116 may be hinged together.

Referring now to the embodiment shown in FIG. 4, the projectile impact indicating target 210 includes spokes 216 that are independently hingedly connected about the base portion 214. Preferably the bead 226 on the projectile impact sensor 222 is in urged engagement with one end 215 of the spokes 216. Upon mounting of the projectile impact sensor 222 on the frame 212, the spokes 216 are held to form the dome-shaped structure of the target 200. When the elastomeric material of the projectile impact sensor 222 is ruptured, the other ends 217 of the spokes 216 are released outwardly under the force of the elastomeric bead 226 and any centrifical force of the target 210 causing the spokes 216 to swing out and the target to act as a falling bird.

In FIG. 5 the projectile impact indicating target 310 is illustrated as a spirally wound wire frame 312 on which the projectile impact sensor 322 is mounted. Preferably, the wire frame 312 is magnetically attracted to facilitate magnetic pickup of a downed target 310. The impact indicator 320 is mounted in a container 318 at the apex of the dome-shaped structure formed by the spirally wound wire. The container 318 can be formed to snap into the wire frame 312.

Each of the projectile impact indicating targets 10, 110, and 210, disclosed can be formed in whole or in part of biodegradable materials. In FIG. 6 the target 410 is constructed of biodegradable material and molded in one piece. This target 410 is designed not to shatter upon projectile impact. In this embodiment the projectile impact sensor 422 is used only to keep the impact indicator 420 contained until the sensor 422 is ruptured by a projectile.

Figure 8:
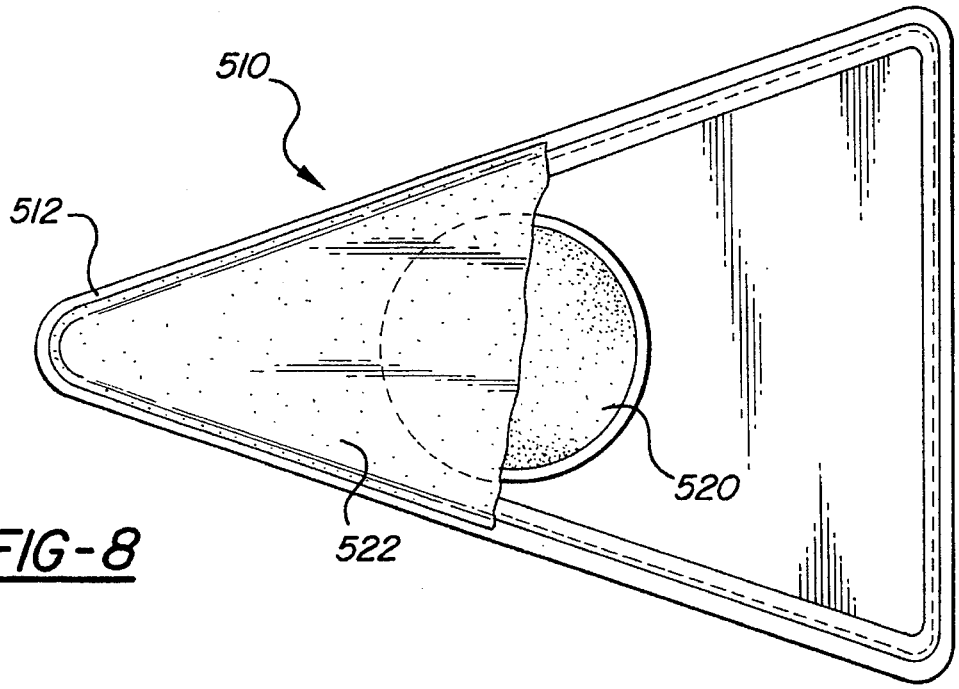
FIG. 8 is a bottom view of the target of FIG. 7.
Figure 9:
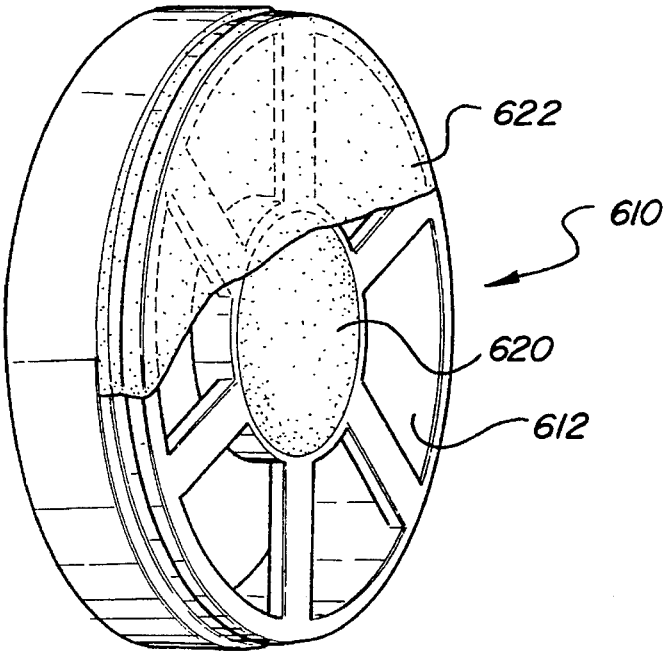
FIG. 9 is a perspective view of a target embodying the invention, constructed to be rolled on the ground.

FIGS. 7 thru 9 illustrate two examples of alternative target shapes. In FIGS. 7 and 8, the target 510 is made to look like an airplane. The frame 512 is of a generally triangular shape and the impact sensor 522 is mounted over the impact indicator 520 on the bottom of the target. In FIG. 9, the target 610 is made to be rolled along the ground as other sporting rabbit clays are rolled. In this embodiment, the frame 612 is of a generally cylindrical shape.

Although the invention has been described by reference to certain specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A projectile impact indicating target characterized by:

a frame;

a projectile impact sensor mounted on said frame for sensing projectile impact; said projectile impact sensor being of an elastomeric material stretched about said frame near its elastic limit; said sensor being rupturable upon projectile impact; and an impact indicator releasably restrained by said projectile impact sensor for indicating projectile impact with said target.

2. The target of claim 1 characterized in that;

said frame is constructed of a plastic material allowing the frame to be reused.

3. The target of claim 2 characterized in that;

said plastic material is urethane.

4. The target of claim 2 characterized in that;

said plastic material is polycarbonate.

5. The target of claim 1 characterized in that;

said frame includes a generally circular shaped base portion having arcuate spokes extending therefrom forming a generally dome-shaped structure.

6. The target of claim 5 characterized in that;

said base portion includes a groove extending around its periphery, and said projectile impact sensor includes a bead engageable in said groove.

7. The target of claim 5 characterized by;

a container having an opening and connected to said spokes at the apex of said dome-shaped structure for containing said impact indicator; said projectile impact sensor normally covering said opening and uncovering said opening upon rupture of said projectile impact sensor.

8. The target of claim 5 characterized in that;

said base portion is separable from said arcuate spokes upon rupture of said elastomeric material.

9. The target of claim 5 characterized in that;

said arcuate spokes act as said impact indicator and pivot on said base portion upon rupture of said elastomeric material.

10. The target of claim 1 characterized in that;

said frame includes a spirally wound frame member forming a generally dome-shaped structure.

11. The target of claim 10 characterized in that;

said spirally wound frame member includes a metallic cone.

12. The target of claim 1 characterized in that;

said impact indicator provides a visible indication.

13. The target of claim 1 characterized in that;

said impact indicator provides an audible indication.

14. The target of claim 1 characterized in that;

said frame includes a magnetically attracted metal portion for magnetic pick up of said target.

15. The target of claim 1 characterized in that;

said frame is of a one piece molded biodegradable material.

* * * * *